US008752333B1

(12) United States Patent
Lewis

(10) Patent No.: US 8,752,333 B1
(45) Date of Patent: Jun. 17, 2014

(54) DOUBLE ACTION DOOR

(71) Applicant: Mahlon Bautista Lewis, Sacramento, CA (US)

(72) Inventor: Mahlon Bautista Lewis, Sacramento, CA (US)

( * ) Notice: Subject to any disclaimer, the term of this patent is extended or adjusted under 35 U.S.C. 154(b) by 0 days.

(21) Appl. No.: 13/743,233

(22) Filed: Jan. 16, 2013

(51) Int. Cl.
*E05D 7/02* (2006.01)

(52) U.S. Cl.
USPC ..... 49/382; 292/41; 292/92; 312/326

(58) Field of Classification Search
USPC ..... 49/382, 192, 193; 312/405, 138.1, 139, 312/325, 326, 327, 328, 329; 292/8, 9, 10, 292/21, 32, 29, 30, 33, 35, 40, 41, 92, 93, 292/94, DIG. 15, DIG. 17, DIG. 21, DIG. 36, 292/DIG. 65
See application file for complete search history.

(56) References Cited

U.S. PATENT DOCUMENTS

| | | | | |
|---|---|---|---|---|
| 2,195,991 | A * | 4/1940 | Lovett | 16/230 |
| 3,396,490 | A * | 8/1968 | Dukas | 49/382 |
| 4,811,518 | A * | 3/1989 | Ladisa | 49/193 |
| 5,064,255 | A * | 11/1991 | Inui et al. | 312/405 |
| 5,560,148 | A * | 10/1996 | Chang | 49/193 |
| 2013/0111817 | A1 * | 5/2013 | Koberling | 49/382 |

FOREIGN PATENT DOCUMENTS

JP 02269283 A * 11/1990 ..... E05D 15/50

* cited by examiner

*Primary Examiner* — Jerry Redman
(74) *Attorney, Agent, or Firm* — Gulf Coast Intellectual Property Group

(57) ABSTRACT

A door operable to swing in either a left handed manner or a right handed manner. The door includes a body having an upper panel and a lower panel. Peripherally mounted to the body is a frame wherein the frame includes a left longitudinal member and a right longitudinal member that are substantially hollow. A control bar is mounted proximate the midpoint of the body. Four pins are movably mounted to each of the four corners of the body. A first push member and a second push member are movably mounted on the control bar and are operable to control the four pins so as to allow the door to be swung in a left handed manner or a right handed manner.

15 Claims, 3 Drawing Sheets

DOUBLE ACTION DOOR

FIELD OF THE INVENTION

The present invention relates generally to doors, more specifically but not by way of limitation a door that is configured to be operable either as a left-side hinge door or a right-side hinge door through utilization of a unique frame.

BACKGROUND

Millions of structures both commercial and residential include a plurality of access points such as but not limited to windows and doorways. Access points allow individuals to either enter a structure or move within a facility from room to room. Most access points such as windows and doorways have structures that include functionality that enables a user to breach the access point as needed or allow the access point to be accessible. Windows are typically designed to be opened so as to allow air to circulate or even allow emergency personnel within a room if needed. Doorways typically include a conventional door that is mounted on a frame that can be placed in an open or closed position as desired.

Conventional doors are mounted using hinges that allow the door to move in at least ninety degree movement pattern so as to allow a user to manipulate the door in between a first and second position so as to either allow access to an area proximate the door or to cordon off an area proximate the door.

One problem with conventional frame mounted doors is their inherent lack of flexibility. Conventional doors are mounted as either a left-side hinge mount or a right-side hinge mount. This configuration is fixed and when a structure is built the frame mounted doors are installed as needed for the current utilization requirements. For example but not by way of limitation, if due to cabinets or other feature within a structure require that a door swing open in a particular direction then the builder will utilize a frame mount that best suits the current need. Unfortunately, as features within a structure are altered, the original direction of the frame-mounted door may no longer meet the requirements of the user of the structure.

Another issue with current frame mounted doors is that sometimes when a user is approaching a door it can be difficult to determine what type of mount has been utilized and therefore which way the door needs to be engaged so as to open. This can be very cumbersome when a user is carrying a load of materials and can result in injury to the user.

Accordingly, there is a need for a door that utilizes a unique mounting system that enables the door mounted therein to be opened such that the door will hinge from either the left side or the right side so as to enhance the usability thereof.

SUMMARY OF THE INVENTION

It is the object of the present invention to provide a door system that is operable to swing in either a left-handed or right-handed configuration without structural alteration.

Another object of the present invention is to provide a door system that includes a double pin configuration that facilitates the door movement such that the door will hinge from either the left side or the right side of the door.

A further object of the present invention is to provide a door system that is operable to swing in a left-handed or right-handed manner that that utilizes an upper pin and a lower pin on each side of the body of the door.

Yet another object of the present invention is to provide a door system that is operable to swing in either a left-handed manner or a right-handed manner that includes a movable cross member that can be engaged from either the rear side or front side of the body of the door.

Still another object of the present invention is to provide a door system that is operable to swing in either a left-handed manner or a right-handed manner that includes a first and second control rod operably connected to upper pins and lower pins.

An additional object of the present invention is to provide a door system operable to hinge from the left side and the right side that can be opened by applying a force to either the left hand longitudinal perimeter of the door or the right hand longitudinal perimeter of the door.

Yet a further object of the present invention is to provide a dual action door system operable to be opened in either a left-handed manner or a right-handed manner so as to facilitate improved opening configurations by a user.

Another object of the present invention is to provide a dual action door system that is operable to be opened from either side of the door in a left-handed manner or a right-handed manner that includes a closure mechanism.

A further object of the present invention is to provide a dual action door system that is operable to be opened from either the front side or rear side of the door in a left-handed manner or a right handed manner that utilizes material such as but not limited to steel and glass.

Still another object of the present invention is to provide a dual action door system that is operable to be opened from both sides of the door in either a left-swing manner or a right-swing manner that includes cavities disposed within the frame or other part of the structure.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
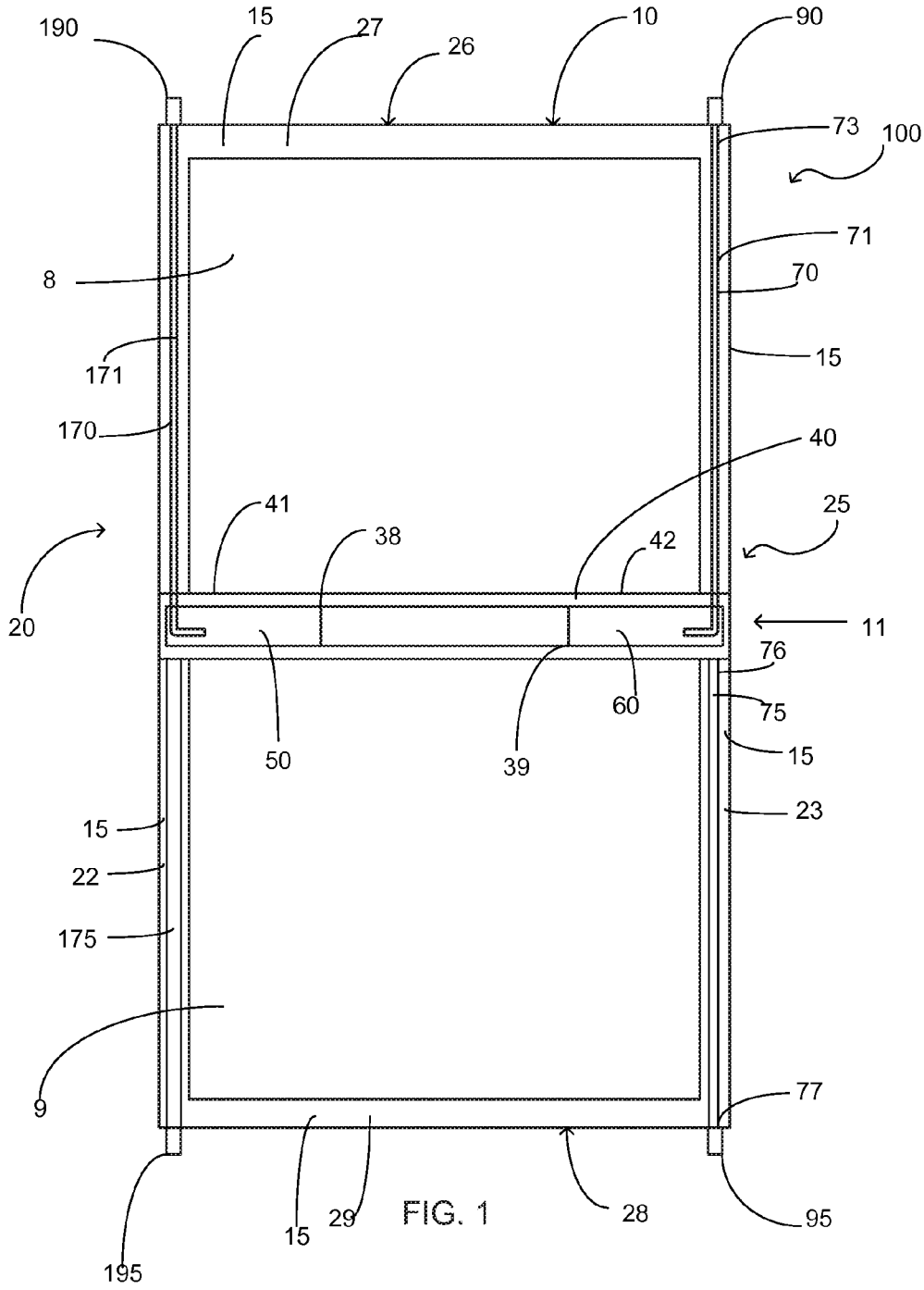
FIG. 1 is a diagrammatic view of a door of the present invention.

Referring now to the drawings submitted herewith, wherein various elements depicted therein are not necessarily drawn to scale and wherein through the views and figures like elements are referenced with identical reference numerals, there is illustrated a door system 100 constructed according to the principles of the present invention.

The door system 100 includes a body 10 having a peripheral frame 15 that is manufactured from a suitable durable material such as but not limited to metal. The body 10 of the door system 100 is substantially planar in manner and is generally rectangular in shape having an upper panel 8 and a lower panel 9. The body 10 includes a left side 20 having a left side frame member 22 and a right side 25 having a right side frame member 23. Additionally the body 10 of the door system includes an upper end 26 and a lower end 28. Intermediate the left side 20 and right side 25 are an upper cross frame member 27 and a lower cross frame member 29 that are located at the upper end 26 and lower end 28 of the body 10 respectively. It is contemplated within the scope of the present invention that the body 10 could be constructed from numerous suitable durable materials such as but not limited to steel, wood or glass.

Located proximate the midpoint 11 of the body 10 is a cross member 40. The cross member 40 is generally rectangular in shape having a first end 41 and a second end 42. The cross member 40 is manufactured from a suitable durable material such as but not limited to metal. The cross member 40 is substantially hollow and further includes a first push member 50 and a second push member 60. The first push member 50 and second push member 60 are movably mounted to the cross member 40 such that the first push member 50 and second push member 60 can be articulated in an inwards-outwards movement. The first push member 50 and second push member 60 are movably mounted on the cross member 40 utilizing pins 38 and 39 respectively. The pins 38, 39 are conventional cylindrical shaped pins that facilitate the ability for the first push member 50 and second push member 60 to be moved in an inward direction towards the body 10 from either side of the body 10. While not illustrated herein, it is contemplated within the scope of the present invention that the first push member 50 and second push member 60 further include a mounting spring or other suitable bias producing element operable to provide a bias and allow the aforementioned movement thereof.

Disposed within the right side frame member 24 is control rod 70. The control rod 70 is manufactured from a suitable durable material such as but not limited to metal. The control rod 70 is operably coupled with the second push member 60. The control rod 70 includes an upper portion 71 and a lower portion 75. The upper portion 71 includes a first end 72 and a second end 73. Similarly, the lower portion 75 includes a first end 76 and a second end 77. The second end 73 of the upper portion 71 is operably coupled to the right side upper pin 90 and the second end 77 of the lower portion 75 is operably coupled to the right side lower pin 95. The second push member 60 upon being transitioned to its second position wherein the second push member 60 has been biased inwards towards the body 10 will move the control rod 70 and its upper portion 71 and lower portion 72 so as to retract the right side upper pin 90 and right side lower pin 95 inwards directionally towards the midpoint 11 into their second position. In their first position, the right side upper pin 90 and left side lower pin 95 extend outward from the upper cross frame member 27 and lower cross frame member 29 respectively so as to engage a cavity 111 adjacent thereto in a frame or other portion of the structure in which the door system 100 is mounted. The cavity 111 is of similar shape as the right side upper pin 90 and right side lower pin 95 and is formed in the floor of the structure in which the door system 100 is mounted. Subsequent being placed in the their second position, the right side upper pin 90 and left side upper pin 95 are disengaged from the adjacent cavity 11 so as to allow the body 10 to swing open in either direction and rotate on pins 190,195.

In order for the door system 100 to be operated such that the body 10 will be swung open by rotating on the right side upper pin 90 and right side lower pin 95 a process similar to the aforementioned will occur. The first push member 50 will be biased inwards thereby engaging control rod 170 and its upper portion 171 and lower portion 175. Control rod 170 is constructed and mounted in a similar manner as control rod 70. The upper portion 171 and lower portion 175 are operably coupled to pins 190, 195 respectively. As the first push member 50 is biased inwards from either the side of the body 10 the pins 190,195 are retracted inwards directionally toward the midpoint 11 thus disengaging the pins 190, 195 from their adjacent cavities 111. Subsequent the pins 190, 195 being transitioned to their second position, the body 10 of the door system 100 will be moved to its open position rotating on pins 90,95.

While not illustrated herein, it is contemplated within the scope of the present invention that the door system 100 could include a closure mechanism on either side of the body 10 so as to facilitate the return of the body 10 to its closed first position. Additionally it is contemplated within the scope of the present invention that the cross member 40 further includes a lockout mechanism that prevents the first push member 50 and second push member 60 from being simultaneously engaged. Those skilled in the art will recognize that numerous types of mechanical fasteners could be utilized to construct a suitable lockout mechanism.

Figure 2:
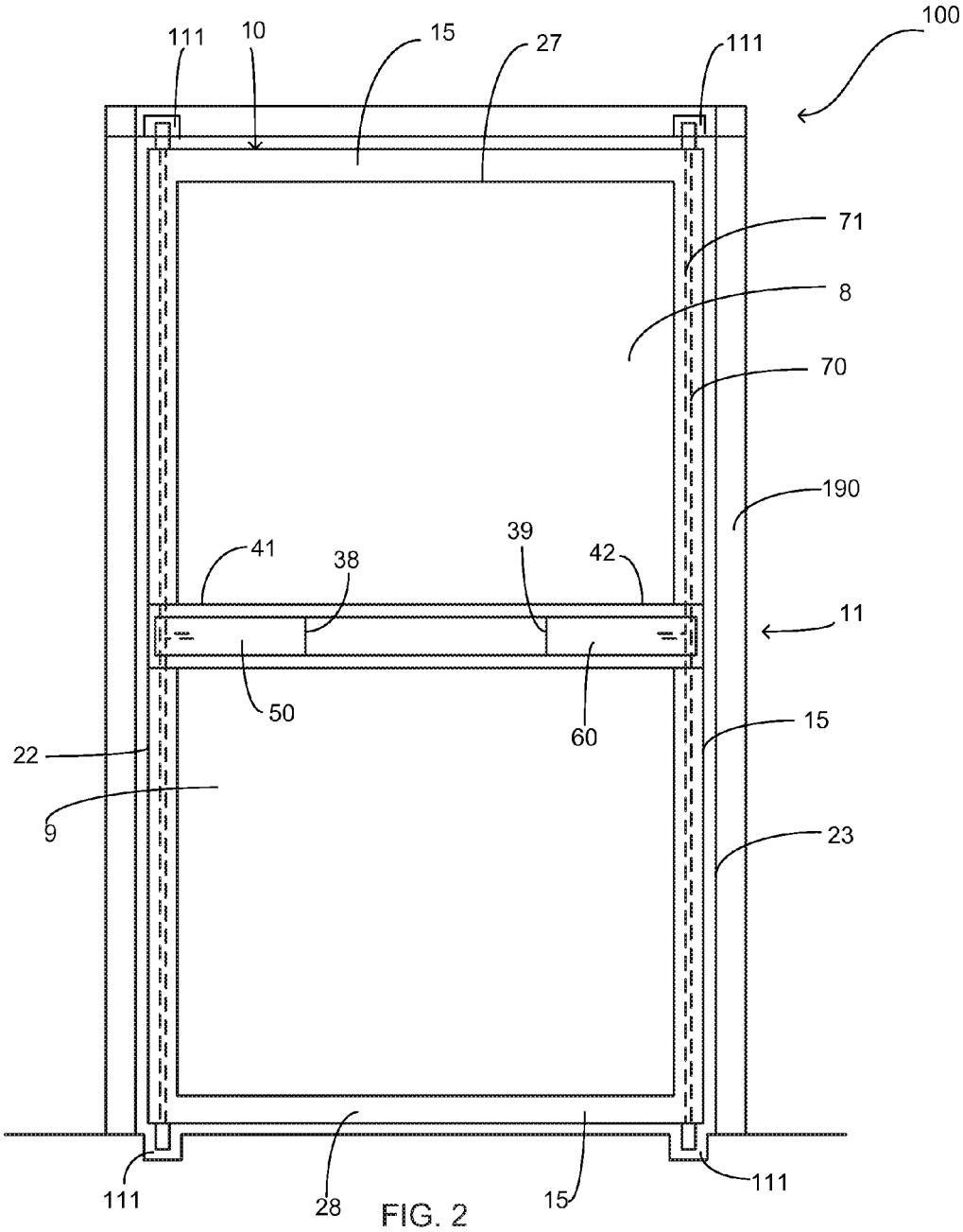
FIG. 2 is a diagrammatic view of the door system including an exemplary frame of a structure.
Figure 3:
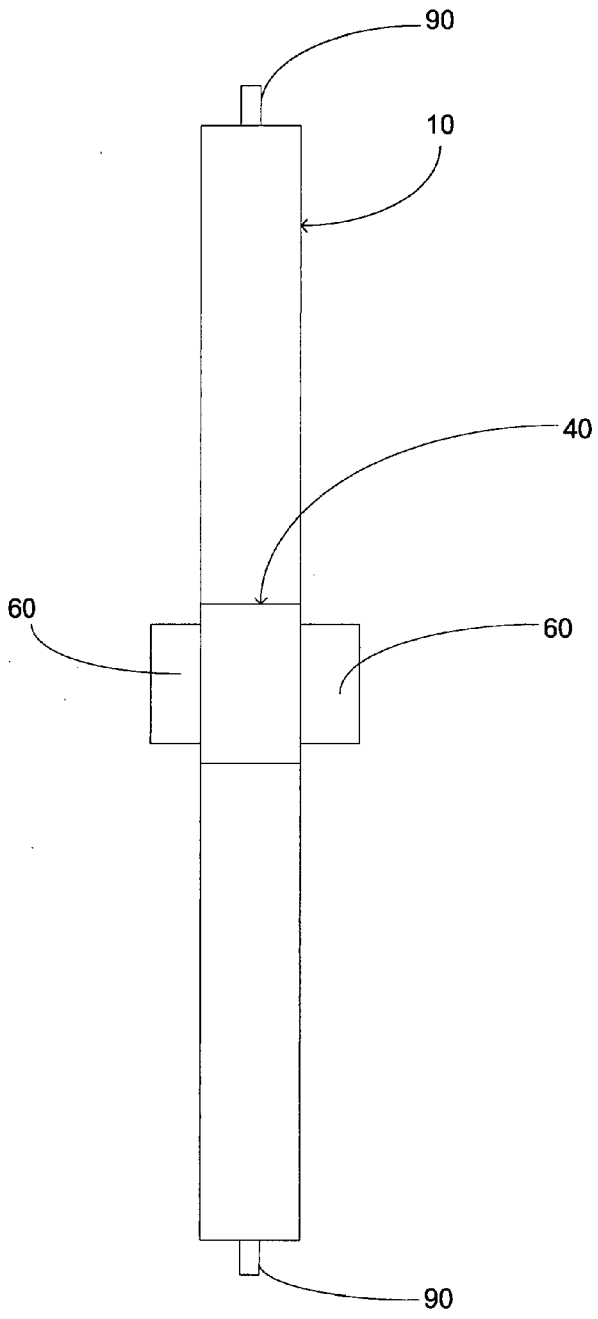
FIG. 3 is a left side diagrammatic view of the present invention.
Figure 4:
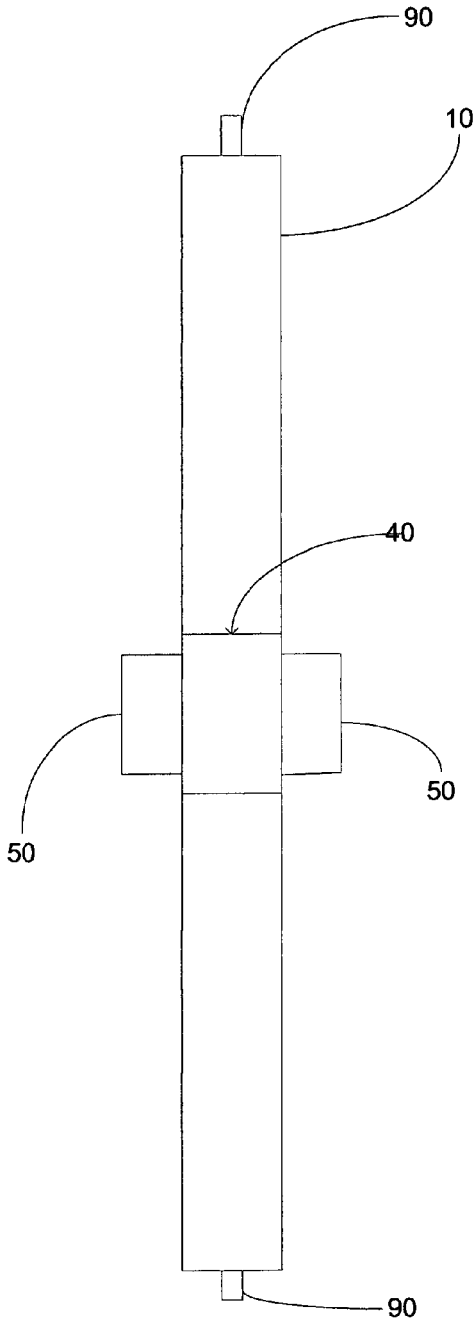
FIG. 4 is a right side diagrammatic view of the present invention.

Referring in particular to FIGS. 1 and 2 herein a description of the operation of the door system 100 is as follows. In use, the body 10 of the door system 100 is mounted within an exemplary frame 199. Ensuing the mounting thereof, a user will engage the first push member 50 and bias in an inwards direction. As the first push member 50 is biased in an inwards direction, the control rod 170 transitions pins 190, 195 to their second position such that pins 190, 195 are retracted inwards towards the 15 and thus released from the adjacent cavities 111 in which pins 190, 195 are at least partially disposed therein in their first positions. Subsequent the pins 190, 195 being transitioned to their second position, the body 10 will swing on pins 90, 95 and open for the user. If a user wishes to open the door system 100 such that the body 10 will swing in an opposite manner, the user will engage the second push member 60 so as to engage control rod 70 moving pins 90, 95 to their second position thus facilitating the body 10 to swing on pins 190,195.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A door comprising:

a body, said body being planar in form, said body being generally rectangular in shape having four corners, said body having a perimeter frame, said body having a left side and a right side, said perimeter frame including a first longitudinal member being secured along said left side and a second longitudinal member being secured along said right side, said perimeter frame further including a first lateral support member and a second lateral support member, said perimeter frame being substantially hollow, said body having a front side and a rear side;

a control bar, said control bar being centrally located on said body, said control bar being intermittent said first longitudinal member and said second longitudinal member, said control bar having a first push member and a second push member, wherein said first push member is accessible from said front side and said second push member is accessible from said rear side;

four pins, said four pins being mounted on each of the four corners of said body, said four pins extending at least partially outward from said body, said four pins operable to facilitate swinging of the door; and wherein said first push member and said second push member are operably coupled to said four pins so as to facilitate opening of the door in a direction either towards a user or away from a user.

2. The door as recited in claim 1, and further including a first control rod, said first control rod being operably coupled to said first push member, said first control rod operably coupling said first push member to two of said four pins on the left side of said body.

3. The door as recited in claim 2, and further including a second control rod, said second control rod being operably coupled to said second push member, said second control rod operably coupling said second push member to two of said four pins on the right side of said body.

4. The door as recited in claim 3, wherein two of said four pins are mounted to said body on said right side of said body at distal ends of said body.

5. The door as recited in claim 4, wherein two of said four pins are mounted to said body on said left side of said body at distal ends of said body.

6. The door as recited in claim 5, wherein said first push member has a first position and a second position, in said second position said first push member has been biased inwards towards said body, in said second position of said first push member said two of four pins on the left side of said body are retracted into said body so as to facilitate the door opening wherein the door hinges on said right side during opening.

7. The door as recited in claim 6, wherein said second push member has a first position and a second position, in said second position said second push member has been biased inwards towards said body, in said second position of said second push member said two of four pins on the right side of said body are retracted into said body so as to facilitate the door opening wherein the door hinges on said left side during opening.

8. A door operable to swing from either the left side or the right side comprising:

a body, said body being rectangular in shape having four corner and further being planar in manner, said body having a peripheral edge therearound, said body having a left side and a right side, said body further including an upper edge and a lower edge, said body having a front side and a rear side, said body further including a frame mounted to said body along said peripheral edge, said frame further including a left longitudinal member and a right longitudinal member, said frame further including an upper support member and a lower support member, said upper support member and said lower support member being intermediate said left longitudinal member and said right longitudinal member and perpendicular thereto;

a control bar, said control bar being mounted intermediate said left longitudinal member and said right longitudinal member, said control bar being proximate a midpoint of said body, said control bar further including a first push member and a second push member, said first push member and said second push member being movably mounted within said control bar, wherein said first push member is accessible from said front side and said second push member is accessible from said rear side;

a first pair of pins, said first pair of pins including an upper pin and a lower pin, said upper pin of said first pair of pins being mounted on said left side of said body proximate said upper edge, said lower pin of said first pair of pins being mounted on said left side of said body proximate said lower edge, said first pair of pins having a first position and a second position;

a second pair of pins, said second pair of pins including an upper pin and a lower pin, said upper pin of said second pair of pins being mounted on said right side of said body proximate said upper edge, said lower pin of said second pair of pins being mounted on said right side of said body proximate said lower edge, said second pair of pins having a first position and a second position; and wherein the door is operable to swing on either said first pair of pins or said second pair of pins so as to open either towards a user or away from a user.

9. The door as recited in claim 8, and further including a first control rod, said first control rod being operably coupled to said first push member and said first pair of pins, said first control rod being operable to transition said first pair of pins intermediate a first position and a second position.

10. The door as recited in claim 9, and further including a second control rod, said second control rod being operably coupled to said second push member and said second pair of pins, said second control rod being operable to transition said second pair of pins intermediate a first position and a second position.

11. The door as recited in claim 10, wherein said left longitudinal member and said right longitudinal member are substantially hollow.

12. The door as recited in claim 11, wherein said first push member has a first position and a second position, in said second position said first push member is biased inwards toward said body, in said second position said first push member being operable to retract said first pair of pins so as to permit the door to swing pivoting on said right side.

13. The door as recited in claim 12, wherein said second push member has a first position and a second position, in said second position said second push member is biased inwards toward said body, in said second position said second push member being operable to retract said second pair of pins so as to facilitate the door to swing pivoting on said left side.

14. The door as recited in claim 13, wherein said control bar is mounted on said body such that said first push member and said second push member are accessible from either side of the door.

15. A door being configured to swing from either side of the door comprising:

a body said body being rectangular in shape having four corners, said body having a first side and a second side, said body further being planar in manner having an upper panel and a lower panel, said body having a front side and a rear side, said body having peripheral edge, said body having an upper edge and a lower edge;

a frame, said frame being disposed around said body proximate said peripheral edge, said frame further including a left longitudinal member and a right longitudinal member, said left longitudinal member and said right longitudinal member being substantially hollow, said frame further including a lower support member, said lower support member being mounted along said lower edge, said frame further including an upper support member, said upper support member being mounted along said upper edge;

a control bar, said control bar being mounted to said body intermediate said upper panel and said lower panel, said control bar having a first end and a second end, said control bar extending horizontally across said body, said control bar having a first push member and a second push member, said first push member and said second push member being operably independent wherein said first push member is accessible from said front side and said second push member is accessible from said rear side;

a first pair of pins, said first pair of pins including an upper pin and a lower pin, said upper pin of said first pair of pins being mounted on said left side of said body proximate said upper edge, said lower pin of said first pair of pins being mounted on said left side of said body proximate said lower edge, said first pair of pins having a first position and a second position;

a second pair of pins, said second pair of pins including an upper pin and a lower pin, said upper pin of said second pair of pins being mounted on said right side of said body proximate said upper edge, said lower pin of said second pair of pins being mounted on said right side of said body proximate said lower edge, said second pair of pins having a first position and a second position;

a first control rod, said first control rod having an upper portion and a lower portion, said first control rod being operably coupled to said first push member and said first pair of pins, said first control rod being operable to transition said first pair of pins intermediate a first position and a second position;

a second control rod, said second control rod having an upper portion and a lower portion, said second control rod being operably coupled to said second push member and said second pair of pins, said second control rod being operable to transition said second pair of pins intermediate a first position and a second position;

wherein said first push member has a first position and a second position, in said second position said first push member is biased inwards toward said body, in said second position said first push member being operable to retract said first pair of pins so as to permit the door to swing pivoting on said right side;

wherein said second push member has a first position and a second position, in said second position said second push member is biased inwards toward said body, in said second position said second push member being operable to retract said second pair of pins so as to facilitate the door to swing pivoting on said left side; and wherein the door is operable to swing on either the first pair of pins or the second pair of pins.

* * * * *